US010683734B2

(12) United States Patent
Merron et al.

(10) Patent No.: US 10,683,734 B2
(45) Date of Patent: Jun. 16, 2020

(54) DISSOLVABLE CASING LINER

(71) Applicant: Halliburton Energy Services, Inc., Houston, TX (US)

(72) Inventors: Matt James Merron, Carrollton, TX (US); Kyle Wayne Davis, Oklahoma City, OK (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/060,151

(22) PCT Filed: Mar. 31, 2016

(86) PCT No.: PCT/US2016/020351
§ 371 (c)(1),
(2) Date: Jun. 7, 2018

(87) PCT Pub. No.: WO2017/171693
PCT Pub. Date: Oct. 5, 2017

(65) Prior Publication Data

US 2019/0017355 A1 Jan. 17, 2019

(51) Int. Cl.

| | |
|---|---|
| ***E21B 43/10*** | (2006.01) |
| ***E21B 33/128*** | (2006.01) |
| ***E21B 43/14*** | (2006.01) |

(52) U.S. Cl.
CPC ..... *E21B 43/108* (2013.01); *E21B 33/128* (2013.01); *E21B 43/10* (2013.01); *E21B 43/14* (2013.01)

(58) Field of Classification Search
CPC ..... E21B 43/10; E21B 43/108; E21B 33/128; E21B 43/14
See application file for complete search history.

(56) References Cited

U.S. PATENT DOCUMENTS

| | | | | |
|---|---|---|---|---|
| 3,366,391 | A | 1/1968 | Gore | |
| 5,069,284 | A | 12/1991 | Gray | |
| 5,346,007 | A | 9/1994 | Dillon et al. | |
| 5,456,319 | A | 10/1995 | Schmidt et al. | |
| 6,761,218 | B2 | 7/2004 | Nguyen et al. | |
| 6,868,910 | B2 | 3/2005 | Corre et al. | |
| 7,284,608 | B2 * | 10/2007 | Reddy | C04B 28/02 166/291 |
| 7,575,062 | B2 * | 8/2009 | East, Jr. | E21B 33/1208 166/305.1 |
| 8,272,437 | B2 | 9/2012 | Bour et al. | |
| 8,910,721 | B1 | 12/2014 | Harris et al. | |

(Continued)

OTHER PUBLICATIONS

International Search Report and the Written Opinion of the International Search Authority, or the Declaration, dated Feb. 2, 2017, PCT/US2016/057138, 16 pages, ISA/KR.

*Primary Examiner* — Yong-Suk Ro
(74) *Attorney, Agent, or Firm* — Haynes and Boone, LLP

(57) ABSTRACT

Dissolvable casing liners are utilized to isolate existing perforations. A dissolvable casing liner is deployed downhole along the interior of a casing string having a plurality of perforations. The casing liner is then secured against the casing string, thereby effectively sealing the perforations. Once the perforations are isolated, refracturing operations may be conducted. At some time thereafter, the casing liner is dissolved and removed from the wellbore.

17 Claims, 4 Drawing Sheets

(56) References Cited

U.S. PATENT DOCUMENTS

| | | | | |
|---|---|---|---|---|
| 9,260,921 | B2 * | 2/2016 | Graham | E21B 7/046 |
| 9,284,824 | B2 * | 3/2016 | Fadul | E21B 43/117 |
| 10,053,940 | B2 * | 8/2018 | Coats | E21B 17/00 |
| 10,087,703 | B2 * | 10/2018 | Thorn | E21B 33/1208 |
| 10,344,568 | B2 * | 7/2019 | Murphree | H05K 3/30 |
| 2011/0011591 | A1 | 1/2011 | Watters et al. | |
| 2013/0068478 | A1 | 3/2013 | Allen et al. | |
| 2014/0110107 | A1 | 4/2014 | Bour et al. | |

* cited by examiner

DISSOLVABLE CASING LINER

CROSS-REFERENCE TO RELATED APPLICATION

The present application is a U.S. National Stage patent application of International Patent Application No. PCT/US2016/020351, filed on Mar. 31, 2016, the benefit of which is claimed and the disclosure of which is incorporated herein by reference in its entirety.

FIELD OF THE DISCLOSURE

The present disclosure relates generally to casing liners useful in refracturing operations and, more specifically, to dissolvable casing liners.

BACKGROUND

In the oil and gas industry, refracturing operations are conducted to re-stimulate existing wellbores. Such operations typically require the isolation of existing perforations. In one method, a casing liner is run downhole to block all or a portion of existing perforations. In another method, fluids are pumped into the existing perforations to provide a temporarily restricted flow path into those zones.

These conventional methods have drawbacks. For example, the use of fluids to temporarily restrict the zones does not provide complete isolation of the existing perforations. As a result, during re-stimulation of the new perforation clusters, some fluids are lost into the existing perforations. This phenomenon is especially troublesome for tight formations which is require higher treating pressures. Also, the casing liners used to block all or a portion of the perforations are typically permanent installations, thus resulting in zones that can no longer be produced—and those casing liners that can be removed require expensive and dangerous removal operations. Moreover, the use of permanent casing liners typically results in a smaller flow diameter which limits the treatment rate during the stimulation service.

DESCRIPTION OF ILLUSTRATIVE EMBODIMENTS

Illustrative embodiments and related methods of the present disclosure are described below as they might be employed in a dissolvable casing liner, also referred to as a "scab liner," and method of using the same. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

As described herein, illustrative embodiments of the present disclosure are directed to dissolvable casing liners and methods of using the same. In a generalized method, a casing liner is deployed downhole along the interior of a casing string having a plurality of perforations. The casing liner is then secured to the casing string to cover one or more of the perforations, whereby the perforations are sealed in a variety of ways. For example, the casing liner may be circumferentially expanded to sealingly engage the casing, thus isolating the perforations. In the alternative, a fluid, heavy weight fluid or gel may be pumped down the annulus between the casing liner and casing to thereby isolate the perforations. Once isolated, refracturing operations may be conducted, for example. When it is desired to remove the casing liner, a dissolving fluid may be pumped downhole, whereby the casing liner is dissolved and the perforations are uncovered. Alternatively, the dissolving fluid may already be present in the wellbore. The dissolved casing liner may then be pumped out of the wellbore.

Figure 1:
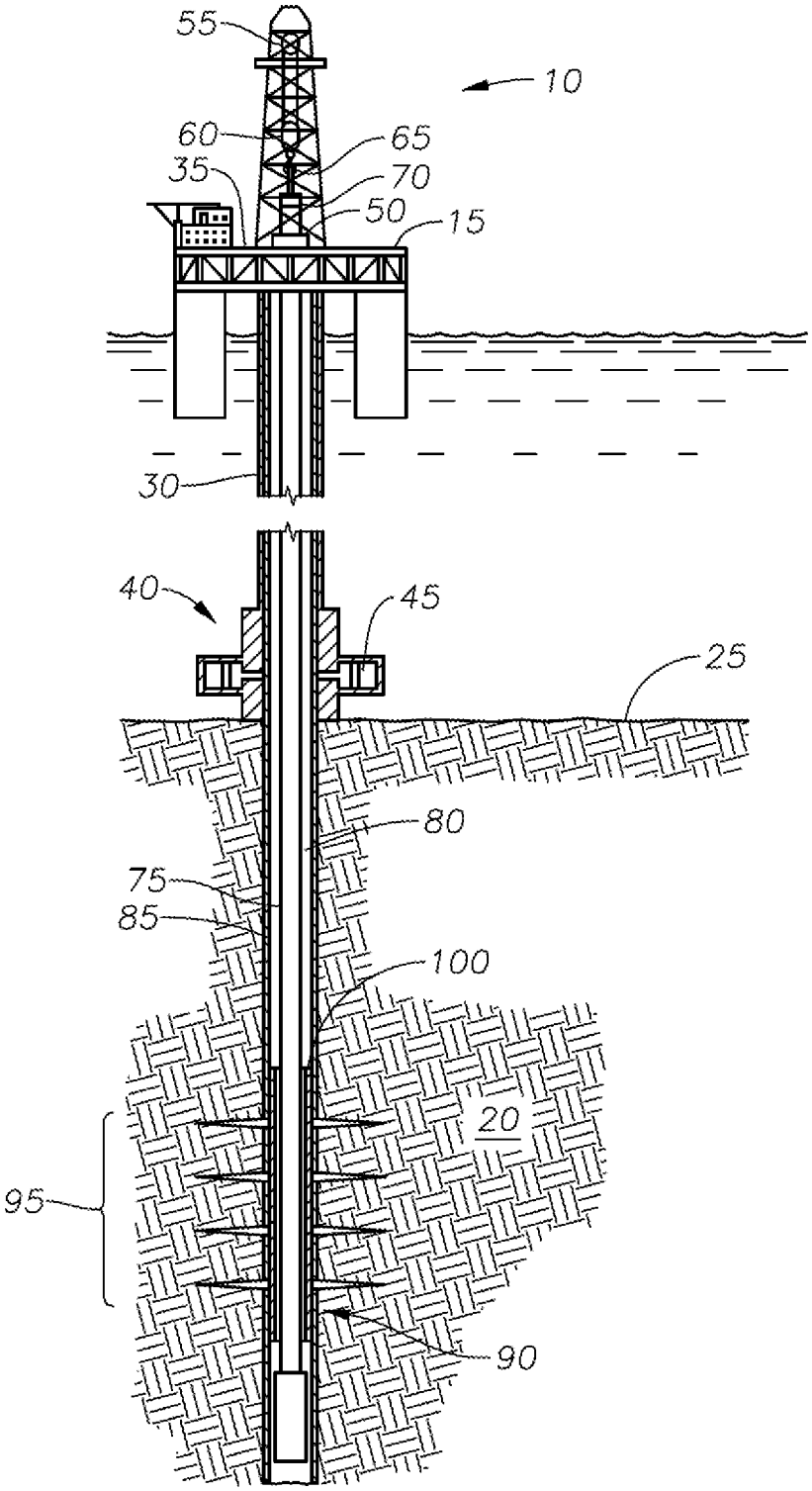
FIG. 1 is a schematic illustration of an offshore oil and gas platform that may employ the principles of the present disclosure, according to one or more illustrative embodiments.

FIG. 1 is a schematic illustration of an offshore oil and gas platform generally designated 10, operably coupled by way of example to a sacrificial protective sleeve according to the present disclosure. Such an assembly could alternatively be coupled to a semi-sub or a drill ship as well. Also, even though FIG. 1 depicts an offshore operation, it should be understood by those ordinarily skilled in the art having the benefit of this disclosure that the apparatus according to the present disclosure is equally well suited for use in onshore operations. By way of convention in the following discussion, though FIG. 1 depicts a vertical wellbore, it will be understood by those same skilled persons that the apparatus according to the present disclosure is equally well suited for use in wellbores having other orientations including, for example, horizontal wellbores, slanted wellbores, multilateral wellbores or the like.

Referring still to the offshore oil and gas platform example of FIG. 1, a semi-submersible platform 15 may be positioned over a submerged oil and gas formation 20 located below a sea floor 25. A subsea conduit 30 may extend from a deck 35 of the platform 15 to a subsea wellhead installation 40, including blowout preventers 45. The platform 15 may have a hoisting apparatus 50, a derrick 55, a travel block 60, a hook 65, and a swivel 70 for raising and lowering pipe strings, such as a substantially tubular, axially extending tubing string 75.

As in the present example embodiment of FIG. 1, a wellbore 80 extends through the various earth strata including the formation 20, with a portion of wellbore 80 having a casing string 85 cemented therein. Disposed in wellbore 80 is a completion assembly 90. Generally, assembly 90 may be any one or more completion assemblies, such as for example a hydraulic fracturing assembly, a gravel packing assembly, etc. The assembly 90 may be coupled to the tubing string 75 extending along casing string 85 which has a plurality of perforations 95 positioned therein. As shown, a casing liner 100, also known as a scab liner, is sealing engaged to casing string 85 atop one or more of perforations 95 (shown in greater detail in FIG. 2).

Figure 2:
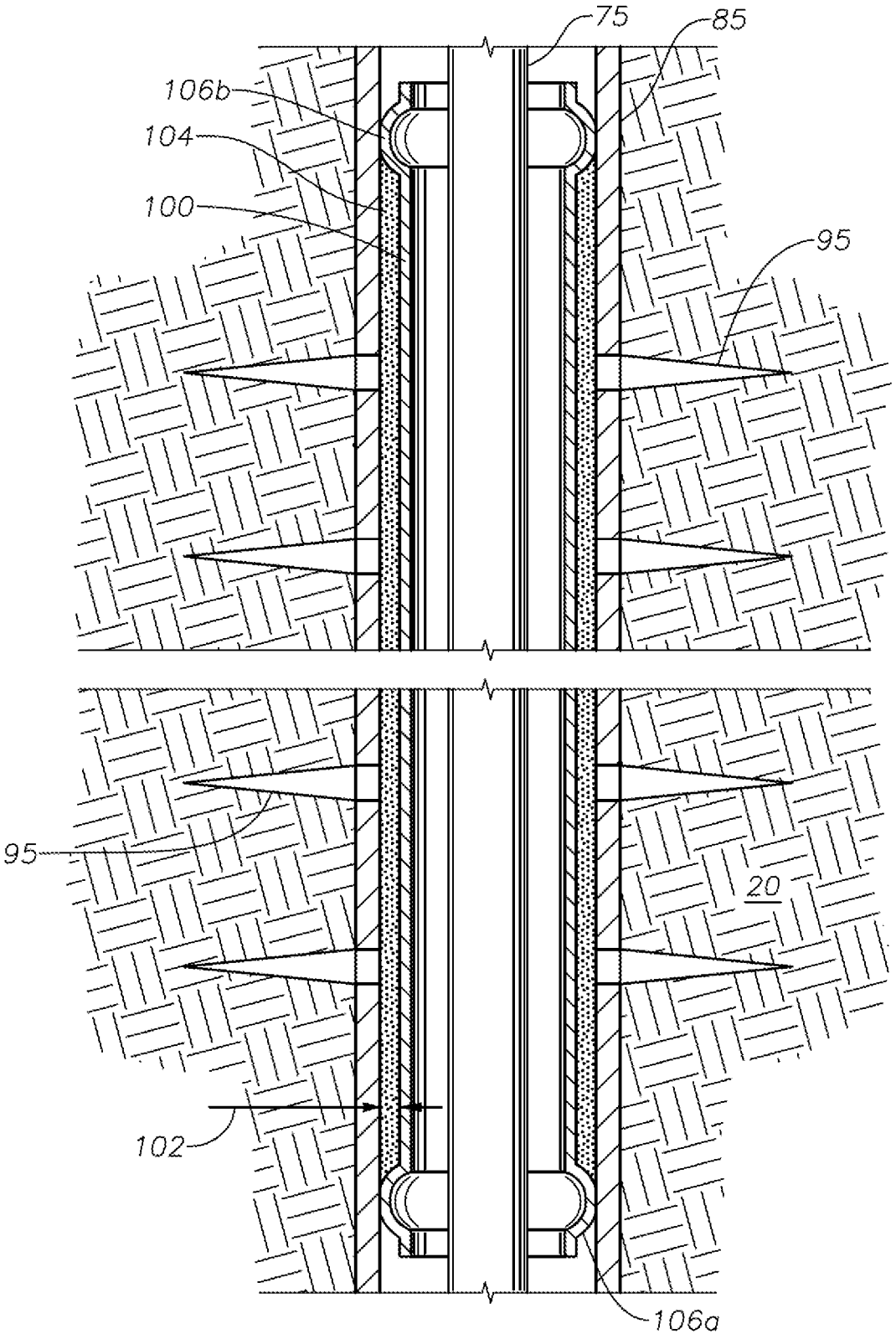
FIG. 2 is an exploded sectional illustration of the casing liner 100 of FIG. 1.

FIG. 2 is an exploded sectional illustration of casing liner 100 of FIG. 1, according to certain illustrative embodiments of the present disclosure. Casing liner 100 is positioned within the interior passageway of casing 85 atop one or more perforations 95. In this example, casing liner 100 is a tube made of a metal or composite material which dissolves in a dissolvable solution, such as, for example, a water-based solution. The dissolvable material used for casing liner 100 may be, for example, a dissolvable metal (or other material) having a dissolution rate in excess of 0.01 $mg/cm^2$/hour at 200 F in 15% KCI (potassium chloride). In other embodiments, the dissolvable material may be, for example, a material that loses greater than 0.1% of its total mass per day at 200 F in 15% KCI.

In certain illustrative embodiments, casing liner 100 is 3-60 feet in length, having a tubing wall thickness of 0.05-2 inches. Casing liner 100 may be deployed along wellbore 80 using a variety of methods, including, for example, using a slickline, wireline or coiled tubing. Deployment may also be via a setting/expansion tool such as, for example, a mechanical, hydraulic or chemical-type setting tool/method. For example, charges used to set fracture plugs may be used to activate a setting tool that would expand the casing liner out to the ID of casing section. The expansion of gas from the charge causes a setting tool to stroke a distance. This mechanical stroke length would pull a setting device through the casing liner that would expand the casing liner out to the surface of the casing section.

Still referring to FIG. 2, once casing liner 100 has been deployed adjacent perforations 95, casing liner 100 may be secured to casing 85 in a variety of ways. In a first example, a heavy weight fluid or gel 104 (or other suitable fluid) may be pumped into annulus 102 formed between casing liner 100 and casing 85. In such a method, fluid 104 will serve to centralize casing liner 100 in wellbore 80, as well as to seal/isolate perforations 95 from wellbore 80, thereby preventing fluid from pumping around casing liner 100 and into perforations 95 (during refracturing operations, for example).

In this illustrative method, ends 106*a* and 106*b* of casing liner 100 have been circumferentially expanded (or deformed) to sealingly engage casing 85, thus preventing fluid 104 from escaping annulus 102, and axially securing casing liner 100 in place. The circumferential expansion of ends 106*a* and 106*b* may be accomplished in a variety of ways, such as, for example, using a setting tool positioned within the interior passageway of casing liner 100. Moreover, in other methods, other portions of casing liner 100 may be circumferentially expanded using a setting or other suitable tool. In yet other methods, all or part of casing liner 100 may be circumferentially expanded using hydraulic pressure applied to the ID of casing liner 100, thus causing it to expand out and sealingly engage casing 85. Such a design would improve the pressure capacity of casing liner 100 since, under pressure loads, casing liner 100 receives support from casing 85.

In yet other illustrative methods, casing liner 100 may include a sealing material on its outer diameter. The sealing material may be, for example, an elastomer or polymer that, upon circumferential expansion, provides a seal to perforations 95. In this method, fluid 104 may or may not be used. In yet other embodiments, the seal material may be positioned along intervals of casing liner 100, such as, for example, at lengths of 1 inch to 60 inches along the outer diameter of casing 100 to thereby seal perforations 95.

Nevertheless, after casing liner 100 has been secured atop perforations 95 whereby they are isolated, further downhole operations may occur, such as refracturing, for example. Since perforations 95 are isolated, the pressure being used to fracture new intervals is not lost into perforations 95. After a desired amount of time and/or with the introduction of a dissolving fluid, casing liner 100 will dissolve into small enough pieces that allow the resulting solution to be pumped back to the surface. The dissolving fluid may be other wellbore fluids already present within wellbore 80 or fluid(s) or other agents that are introduced to wellbore 80 at some desired time. Once perforations 95 are uncovered, they are accessible again for wellbore operations.

Figure 3A:
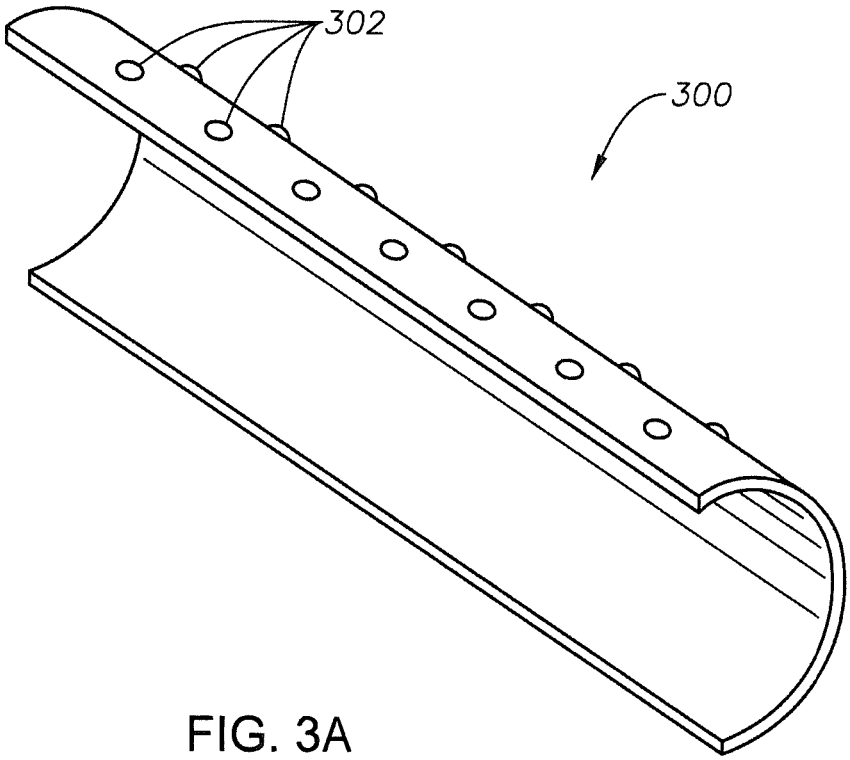
FIG. 3A is a three-dimensional illustration of a casing liner having axial retention components thereon, according to certain illustrative embodiments of the present disclosure.

FIG. 3A is a three-dimensional perspective illustration of a casing liner having axial retention components thereon, according to certain illustrative embodiments of the present disclosure. In this example, casing liner 300 includes a plurality of ceramic buttons 302 to assist in axially retaining casing liner 100 along the casing string (i.e., axial retention components). The buttons may be made of a variety of other suitable materials and applied to the OD of casing liner 300 using a variety of methods (e.g., brazing). Upon circumferential expansion of casing liner 300, buttons 302 will penetrate into the casing string, thus effectively sealing the desired perforations and/or axially locking casing liner 100 in place. In other embodiments, the axial retention components may be a granulated ceramic material placed along the OD of casing liner 300.

Figure 3B:
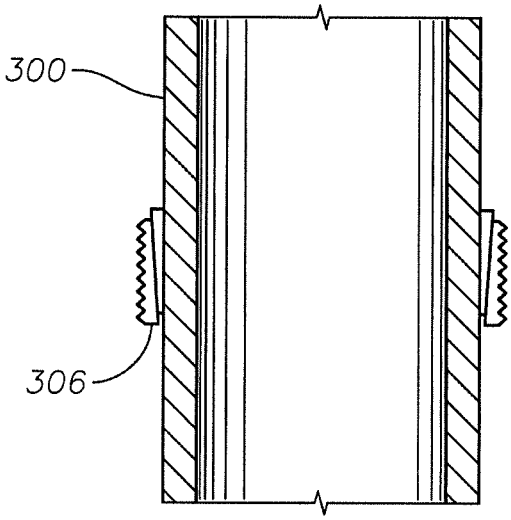
FIG. 3B is a sectional illustration of a casing liner employing a slip mechanism as an axial retention component, according to an alternative embodiment of the present disclosure.

FIG. 3B is a sectional illustration of a casing liner having a slip mechanism as an axial retention component, according to an alternative embodiment of the present disclosure. In this example, casing liner 300 has a slip mechanism 306 positioned along one or more portions of its OD. Upon circumferential expansion of casing liner 300, slip mechanism 306 engages the casing string, thus providing axial retention of casing liner 300. In addition to the body of casing liner 300, slip mechanism 306 may also be made of a dissolvable material so that it can also be pumped back out of the wellbore. In yet other illustrative embodiments of the present disclosure, ends 106*a* and 106*b* (FIG. 2) may have a collet-shape geometry in order to aid in deformation during circumferential expansion.

Figure 4:
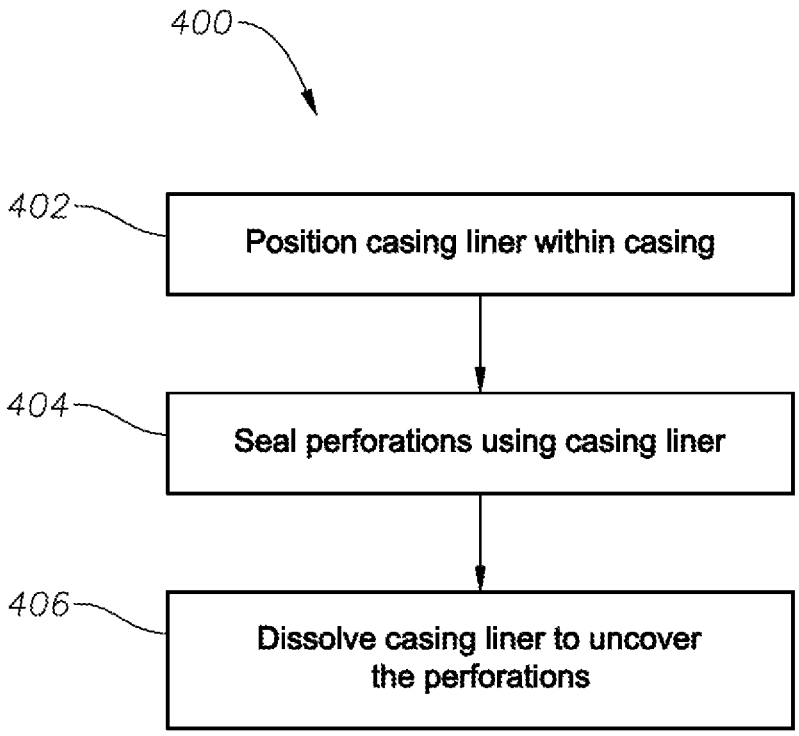
FIG. 4 is a flow chart of method for sealing perforations using a dissolvable casing liner, according to certain illustrative methods of the present disclosure.

FIG. 4 is a flow chart of method for sealing perforations using a casing liner, according to certain illustrative methods of the present disclosure. In method 400, the casing liner is deployed downhole within the casing string to a desired position covering one or more perforations, at block 402. In certain methods, the casing liner may be centralized in the wellbore using, for example, fluid pumped in the annulus between the casing liner and the casing. At block 404, the covered perforations are sealed using the casing liner in a variety of ways. For example, fluid may be pumped into the annulus between the casing liner and casing string, and the casing liner circumferentially expanded at its upper and lower end, thus sealing the fluid in the annulus. In other methods, no fluid may be pumped into the annulus; instead, a portion or all of the casing liner may be circumferentially expanded to seal against the casing liner. In such methods, the OD of the casing liner may be coated with a seal material sufficient to seal against the casing liner. The circumferential expansion of the casing liner may be conducted using, for example, a setting tool or hydraulic pressure applied to the ID of the casing liner.

Once sealed, any number of downhole operations may be performed, such as, for example, refracturing operations. After the desired operation is performed, at block 406, the casing liner is dissolved to thereby uncover the perforations. The casing liner may be dissolved in a variety of ways. First, for example, a first fluid already present in the wellbore may have been dissolving the casing liner since it was initially deployed (the "second fluid" being the fluid present in the casing liner/casing string annulus, if employed). In such cases, the material used to construct the casing liner, and the fluid itself, are selected to result in the necessary dissolution rate for the desired operation. In other methods, for example, the dissolving fluid is introduced at some desired time, and the casing liner dissolved accordingly. Nevertheless, once the casing liner has been dissolved, it may be pumped out of the wellbore whereby further downhole operations may be conducted.

Accordingly, the illustrative casing liners and methods described herein provide a temporary seal for existing perforations along a casing string which can be achieved in a single downhole trip. In addition, the casing liners also provide an open ID to allow other tools to pass through or allow flow back of the zones from below in the wellbore. Although refracturing operations are discussed herein, the casing liners may be used in a variety of other downhole operations, as will be understood by those ordinarily skilled in the art having the benefit of this disclosure. The dissolvable casing liner will eliminate the need for any additional operations to remove the casing liner from the wellbore.

Thus, the present disclosure allows production of the original perforations to return once the casing liner has dissolved (after the re-stimulation service of the new perforation clusters). Moreover, the casing liners will offer better isolation (more perfect fluid isolation) and higher pressure capability that conventional approaches.

Embodiments and methods of the present disclosure described herein further relate to any one or more of the following paragraphs:

1. A downhole method, comprising extending a casing liner within an interior passageway of a casing positioned along a wellbore, the casing having a plurality of perforations therein; securing the casing liner to the casing such that at least a portion of the plurality of perforations is covered by the casing liner; passing a first fluid through an interior passageway of the casing liner; and dissolving the casing liner using the first fluid to uncover the plurality of perforations.

2. A method as defined in paragraph 1, wherein securing the casing liner further comprises sealing the perforations covered by the casing liner.

3. A method as defined in paragraphs 1 or 2, wherein sealing the perforations comprises pumping a second fluid into an annulus formed between the casing liner and casing.

4. A method as defined in any of paragraphs 1-3, wherein extending the casing liner further comprises pumping a second fluid into an annulus formed between the casing liner and casing; and centralizing the casing liner using the second fluid.

5. A method as defined in any of paragraphs 1-4, wherein sealing the perforations comprises circumferentially expanding a portion of the casing liner to sealingly engage the casing.

6. A method as defined in any of paragraphs 1-5, wherein the casing liner is circumferentially expanded using a tool positioned within an interior passageway of the casing liner.

7. A method as defined in any of paragraphs 1-6, wherein the casing liner is circumferentially expanded using hydraulic pressure.

8. A method as defined in any of paragraphs 1-7, wherein the casing liner is secured to the casing using slips positioned along the casing liner.

9. A method as defined in any of paragraphs 1-8, wherein the casing liner is secured to the casing using axial retention components positioned along the casing liner.

10. A method as defined in any of paragraphs 1-9, further comprising pumping the dissolved casing liner out of the wellbore.

11. A downhole method, comprising extending a casing liner within a casing positioned along a wellbore, the casing having a plurality of perforations therein; sealing a portion of the plurality of perforations covered by the casing liner; and dissolving the casing liner to uncover the perforations.

12. A method as defined in paragraph 11, wherein sealing the perforations comprises pumping a fluid into an annulus formed between the casing liner and casing.

13. A method as defined in paragraphs 11 or 12, wherein extending the casing liner further comprises pumping a fluid into an annulus formed between the casing liner and casing; and centralizing the casing liner using the second fluid.

14. A method as defined in any of paragraphs 11-13, wherein sealing the perforations comprises circumferentially expanding a portion of the casing liner to sealingly engage the casing.

15. A method as defined in any of paragraphs 11-14, wherein the casing liner is circumferentially expanded using an expansion tool.

16. A method as defined in any of paragraphs 11-15, wherein the casing liner is circumferentially expanded using hydraulic pressure.

17. A method as defined in any of paragraphs 11-16, wherein the casing liner is secured to the casing using slips positioned along the casing liner.

18. A method as defined in any of paragraphs 11-17, wherein the casing liner is secured to the casing using axial retention components positioned along the casing liner.

19. A method as defined in any of paragraphs 11-18, further comprising removing the dissolved casing liner from the wellbore.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the illustrative term "below" can encompass both an orientation of above and below. The apparatus may be otherwise oriented (rotated 90 degrees or at other orientations) and the spatially relative descriptors used herein may likewise be interpreted accordingly.

Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Rather, the intention is to cover all modifications, equivalents and alternatives falling within the spirit and scope of the disclosure as defined by the appended claims.

What is claimed is:

1. A downhole method, comprising:

extending a casing liner within an interior passageway of a casing positioned along a wellbore, the casing having a plurality of perforations therein;

securing the casing liner to the casing such that at least a portion of the plurality of perforations is covered by the casing liner;

pumping a second fluid into an annulus formed between the casing liner and casing, passing a first fluid through an interior passageway of the casing liner; and dissolving the casing liner using the first fluid to uncover the plurality of perforations;

wherein securing the casing liner further comprises circumferentially expanding a downhole portion of the casing liner to sealingly engage the casing and prevent the second fluid from escaping the annulus.

2. The method as defined in claim 1, wherein securing the casing liner further comprises sealing the perforations covered by the casing liner.

3. The method as defined in claim 2, wherein sealing the perforations comprises circumferentially expanding an uphole portion of the casing liner to sealingly engage the casing such that the second fluid is in the annulus between the downhole portion and the uphole portion of the casing liner.

4. The method as defined in claim 3, wherein the casing liner is circumferentially expanded using a tool positioned within an interior passageway of the casing liner.

5. The method as defined in claim 3, wherein the casing liner is circumferentially expanded using hydraulic pressure.

6. The method as defined in claim 1, wherein extending the casing liner further comprises centralizing the casing liner using the second fluid.

7. The method as defined in claim 1, wherein the casing liner is secured to the casing using slips positioned along the casing liner.

8. The method as defined in claim 1, wherein the casing liner is secured to the casing using axial retention components positioned along the casing liner.

9. The method as defined in claim 1, further comprising pumping the dissolved casing liner out of the wellbore.

10. A downhole method, comprising:

extending a casing liner within a casing positioned along a wellbore, the casing having a plurality of perforations therein;

sealing a portion of the plurality of perforations covered by the casing liner; and dissolving the casing liner to uncover the perforations;

wherein sealing the perforations comprises pumping a fluid into an annulus formed between the casing liner and casing and circumferentially expanding a downhole portion of the casing liner to sealingly engage the casing and prevent the fluid from escaping the annulus.

11. The method as defined in claim 10, wherein extending the casing liner further comprises centralizing the casing liner using the fluid.

12. The method as defined in claim 10, wherein sealing the perforations further comprises circumferentially expanding an uphole portion of the casing liner to sealingly engage the casing such that the fluid is in the annulus between the downhole portion and the uphole portion of the casing liner.

13. The method as defined in claim 12, wherein the casing liner is circumferentially expanded using an expansion tool.

14. The method as defined in claim 12, wherein the casing liner is circumferentially expanded using hydraulic pressure.

15. The method as defined in claim 10, wherein the casing liner is secured to the casing using slips positioned along the casing liner.

16. The method as defined in claim 10, wherein the casing liner is secured to the casing using axial retention components positioned along the casing liner.

17. The method as defined in claim 10, further comprising removing the dissolved casing liner from the wellbore.

* * * * *